US005214842A

United States Patent [19]

Chen

[11] Patent Number: 5,214,842

[45] Date of Patent: Jun. 1, 1993

[54] CRIMPER FOR CRIMPING A MULTI-WIRE TELEPHONE CABLE

[76] Inventor: Ching-Jen Chen, No. 33-1, Luh-Tyi St., Panchiao City, Taipei Hsien, Taiwan

[21] Appl. No.: 922,988

[22] Filed: Jul. 30, 1992

[51] Int. Cl.[5] ..... H01R 43/04

[52] U.S. Cl. ..... 29/749; 29/564.4; 29/564.8; 29/566.4; 29/751; 81/426

[58] Field of Search ..... 29/749, 751, 753, 861, 29/564.4, 564.8, 566.4; 81/426

[56] References Cited

U.S. PATENT DOCUMENTS

| | | | |
|---|---|---|---|
| 4,862,580 | 9/1989 | Wang et al. | 29/751 X |
| 4,981,032 | 1/1991 | Chen | 29/751 X |
| 5,109,591 | 5/1992 | Hung | 29/751 X |

*Primary Examiner*—Carl E. Hall
*Attorney, Agent, or Firm*—Lucas & Just

[57] ABSTRACT

A crimper includes two elongated handle members each having a press portion, and a solid head member disposed between the two press portions of the elongated handle members. The head member has a plurality of differently-sized receiving spaces, two opposed contact faces and a plurality of sets of throughbore pairs extending from one of the contact faces. A plurality of press members are respectively disposed in the throughbores but protrude out from one of the contact faces. When the first and second handle members are pivoted to the head member, the handle members can pivot relative to the head member between a gripping position, wherein the press portions abut with the contact faces and urge the press members to extend into the respective receiving spaces, and a releasing position, wherein the press portions of the first and second handle members are spaced from the contact faces to permit the press members to extend out of the contact faces.

3 Claims, 7 Drawing Sheets

CRIMPER FOR CRIMPING A MULTI-WIRE TELEPHONE CABLE

BACKGROUND OF THE INVENTION

1. Field of the Invention

The invention relates to a crimper, more particularly to a crimper for crimping a multi-wire telephone cable, which crimper includes a head member having a plurality of receiving spaces for accommodating connectors of different dimension into which the telephone cable is to be crimped.

2. Description of the Related Art

There are different types of telephone cables used in telephone signaling, such as six-wire cables, eight-wire cables and twelve-wire cables. Such cables require individual crimpers with differently-sized connector receiving spaces since conventional crimpers include only one connector receiving space to receive a connector which has a specific dimension.

FIGS. 1 and 2 show a connector for a multi-wire telephone cable. The connector includes a casing (A) having a blind bore (a1) to receive one end of a stripped multi-wire cable (b), a plurality of electric terminals (a2) extending into the blind bore (a1) and being crimped so as to engage respectively one of the wires of the cable (b), and a press member (a3) which is to be crimped by a crimper so as to engage the sheath of the cable (b).

Referring to FIGS. 3, 4(A) and 4(B), a conventional crimper (C) includes first and second elongated handle members (C11, C12) pivoted to one another and having rear handle portions. A first crimping component is provided anterior to the pivot point of the elongated handle members and includes a first press member (C24) formed on the second elongated handle member (C12) and a first connector receiving space (f) formed on the first elongated handle member (C11). A second crimping component is provided posterior to the pivot point and includes a second press member (C25) and a second connector receiving space (g) which has a dimension that is different from the first connector receiving space (f). The second press member (C25) and the second connector receiving space (g) are respectively formed on the first and second elongated handle members (C11, C12) so that the press members (C24, C25) can be guided into the receiving spaces (f, g) to effect crimping operation.

The drawbacks of the above-identified crimper are as follow:

(1) In the above-identified crimper (C), the press members (C24, C25) are mounted in the oblong holes (C16) which permit slight adjustments in the position of the press members (C24, C25) relative to the receiving spaces (f, g). During the crimping operation, the force which is applied on the rear handle portions is transmitted to the press members (C24, C25) via a locking bolt (C26) that holds the press members (C24, C25) in the oblong holes (C16) of the handle members (C11, C12). In order to fit the press members (C24, C25) precisely into the receiving spaces (f, g), the press members (C24, C25) move in the oblong hole (C16) to adjust the positions thereof relative to the receiving space (f, g) before carrying out the crimping operation. Movement of the press members (C24, C25) in the oblong hole (C16) decreases the force which reaches the receiving spaces thereof.

(2) Two molds for molding the first and second handle members (C11, C12) with differently-sized notches (C14, C15) are required. Another two molds for molding two clamping blocks (C21, C22) which are placed over the notches (C14, C15) so as to define differently-sized receiving spaces (f,g) for accommodating connectors therein, are also required. The conventional crimper (C) further requires molds for producing press members (C24, C25) thereby increasing the manufacturing cost thereof.

(3) The assembly time of the above mentioned crimper (C) is relatively long.

SUMMARY OF THE INVENTION

Therefore, a main object of the present invention is to provide a crimper for crimping a multi-wire telephone cable which is easy to assemble.

Another object of the present invention is to provide a crimper which is easy to manufacture and which has a lower manufacturing cost when compared to the prior art model.

Still another object of the present invention is to provide a crimper which includes a head member disposed between two press portions of the handle members and having a plurality of differently-sized receiving spaces to accommodate a plurality of differently-sized connectors so that the crimper can collectively and selectively crimp multi-wire telephone cables thereto.

The crimper for crimping telephone cables into one of a plurality of differently-sized connectors according to the present invention includes first and second handle members, each of which having a lower grip portion, an upper press portion which extends upward from the grip portion and a pivot portion which extends upward from the press portion, and a head member having a plurality of receiving spaces that are respectively configured, to accommodate one of the connectors therein, and two opposed contact faces, several sets of throughbore pairs extending from one of the contact faces so as to access a respective one of the receiving spaces. A plurality of sets of elongated press members is disposed in a respective one of said sets of said throughbore pairs. Means are provided for connecting the press members to the head member to permit movement of the press member to move between a first position wherein a first end of the press members protrudes out of the contact face while a second end of the press members retracts into the respective one of throughbores, and a second position, wherein the first end of the press members retracts into the respective one of the throughbores while the second end of the press members extends into the receiving space. When the pivot portions of the first and second hand members are pivoted to the head member, the press portions are located adjacent to the contact faces. Under this condition, the first and second handle members can pivot relative to the head member between a gripping position, wherein the press portions abut with the contact faces to urge the press members toward the second position so as to crimp the electric terminals, and a releasing position, wherein the press portions of the handle members are spaced from the contact faces to allow movement of the press members toward the first position. A biasing means is provided to bias the first and second handle members toward the releasing position.

BRIEF DESCRIPTION OF THE DRAWINGS

Other features and advantages of the present invention will become more apparent in the following detailed description, including drawings, all of which show a non-limiting form of the present invention, and in which.

DETAILED DESCRIPTION OF THE PREFERRED EMBODIMENT

Figure 1:
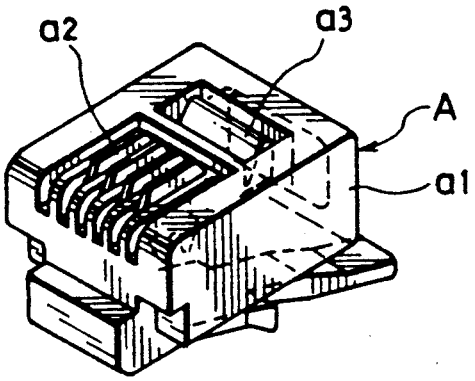
FIG.1 (PRIOR ART)
FIGS. 1 and 2 respectively show a schematic view and a side view of a conventional connector for a multi-wire telephone cable.
Figure 2:
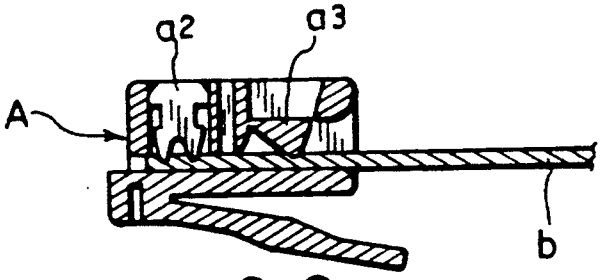
FIG.2 (PRIOR ART)
Figure 3:
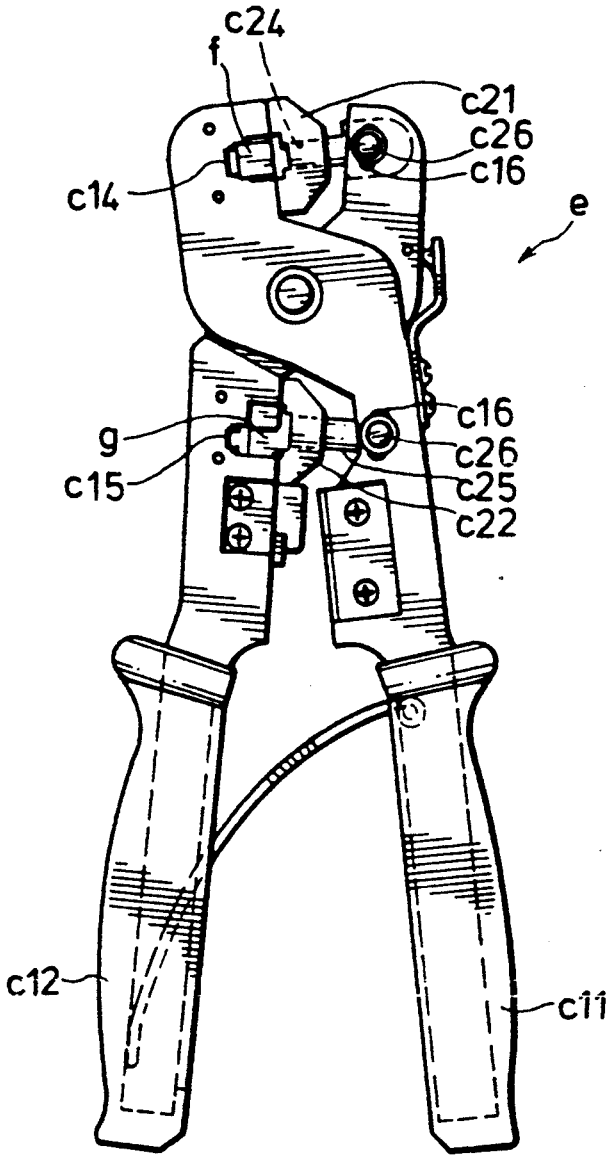
FIG. 3 (PRIOR ART)
FIG. 3 shows a conventional crimper used for crimping a telephone cable into the connector shown in FIGS. 1 and 2.
Figure 4A:
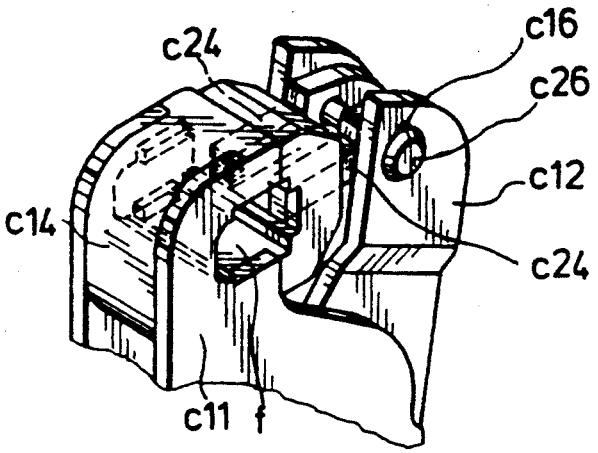
FIG.4A (PRIOR ART)
FIGS. 4(A) and 4(B) illustrate the configuration of the press members of the crimper shown in FIG. 3 when used to crimp the telephone cable into the connector.
Figure 4B:
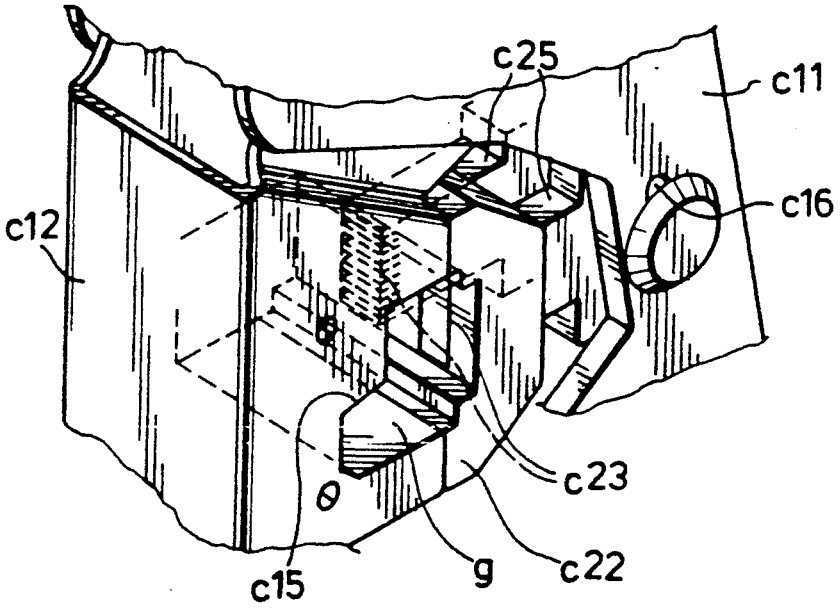
FIG.4B (PRIOR ART)
Figure 5:
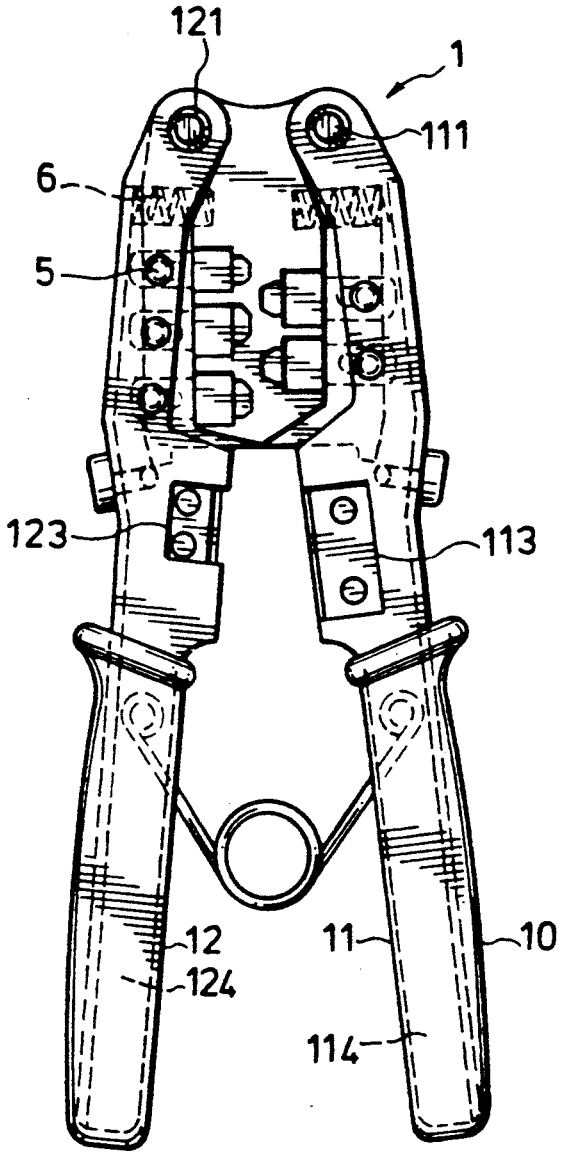
FIG. 5 shows the preferred embodiment of a crimper for crimping a telephone cable into a telephone connector according to the present invention.
Figure 6:
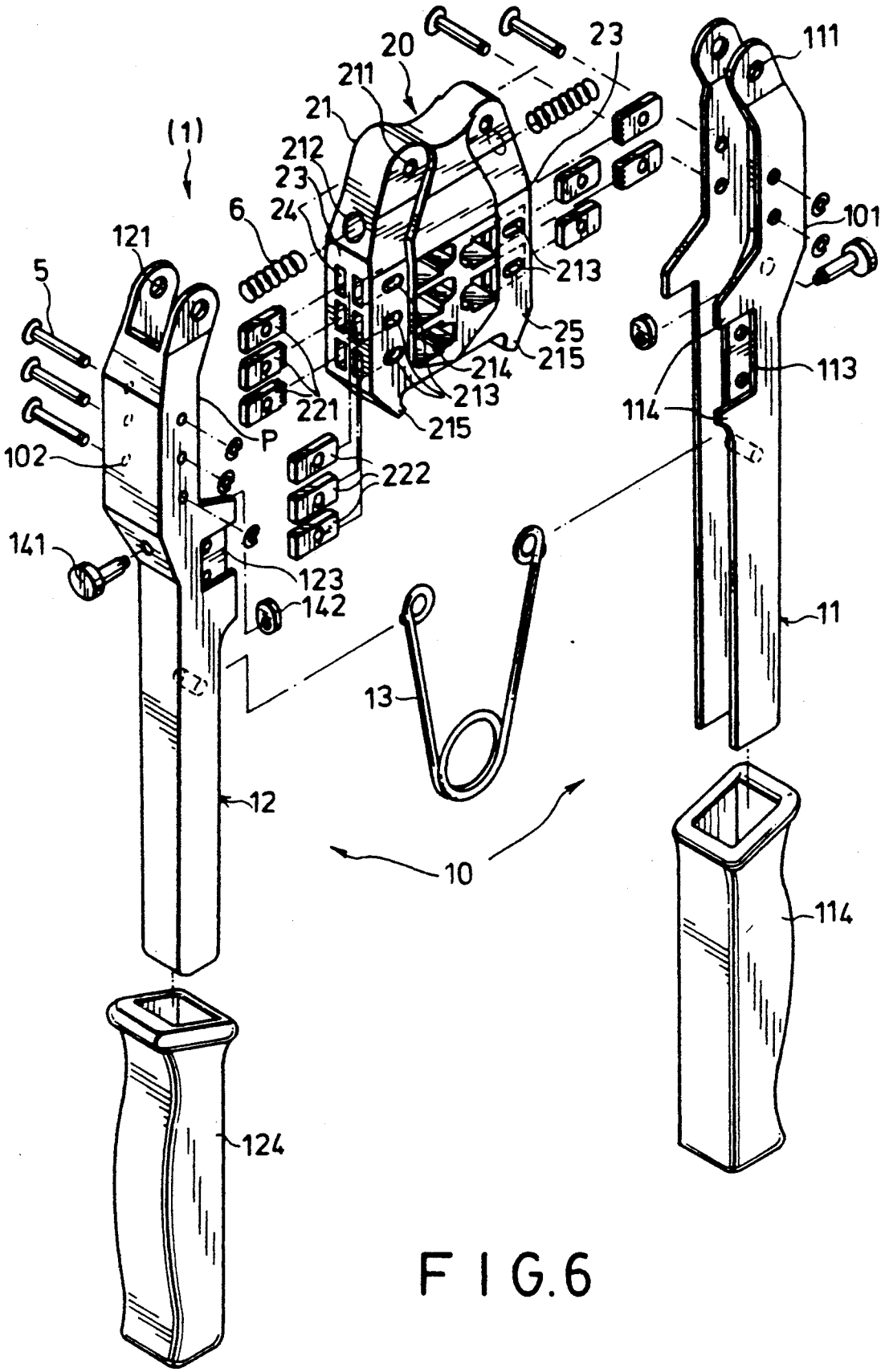
FIG. 6 shows an exploded view of the crimper described in FIG. 5.
Figure 8:
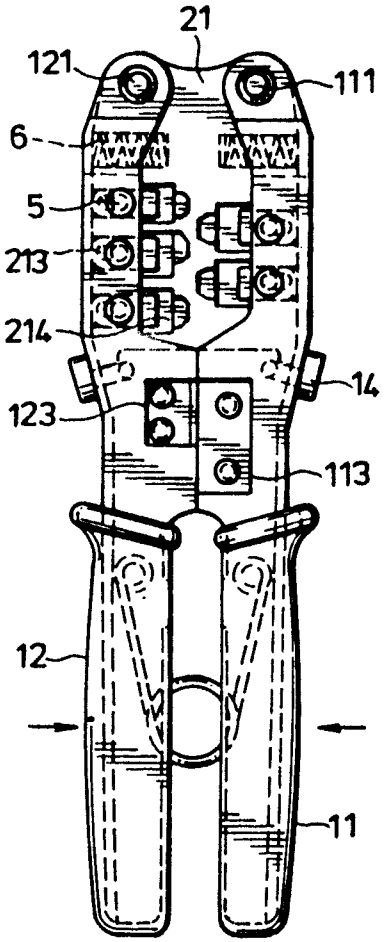
FIG. 8 shows the crimper of the present invention at a crimping position, the perforated lines illustrating the press portions of the crimper when applying pressure on the press member.
Figure 7:
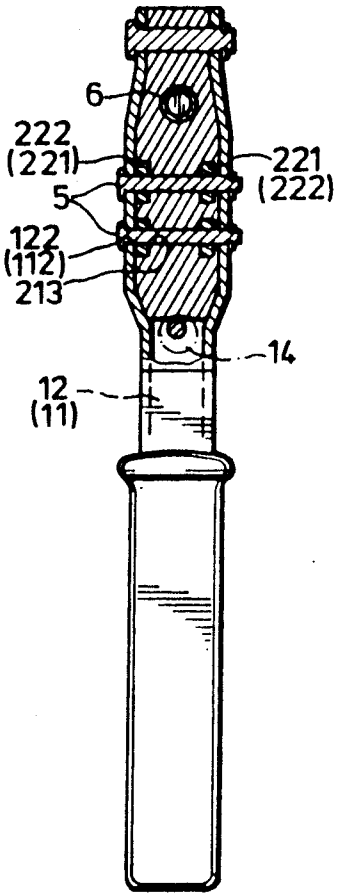
FIG. 7 shows a side view of the crimper according to the present invention.
Figure 10:
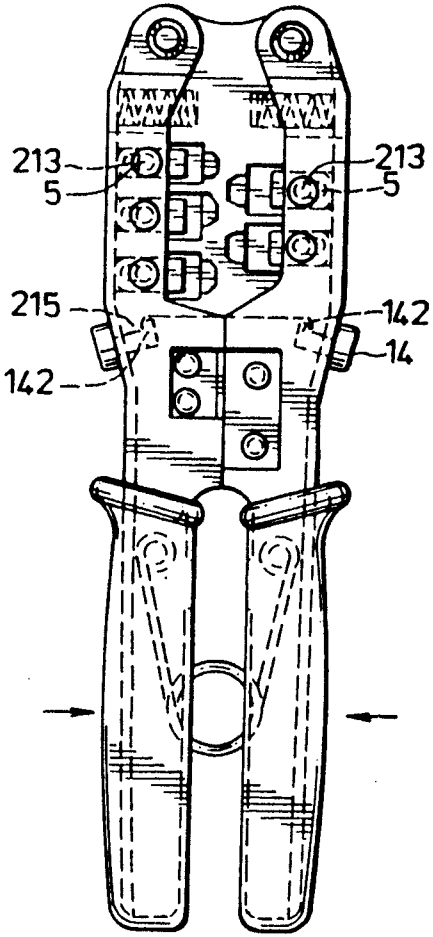
FIG. 10 shows the crimper of the present invention when held at the crimping position by an adjustable knob that is attached thereto.
Figure 9:
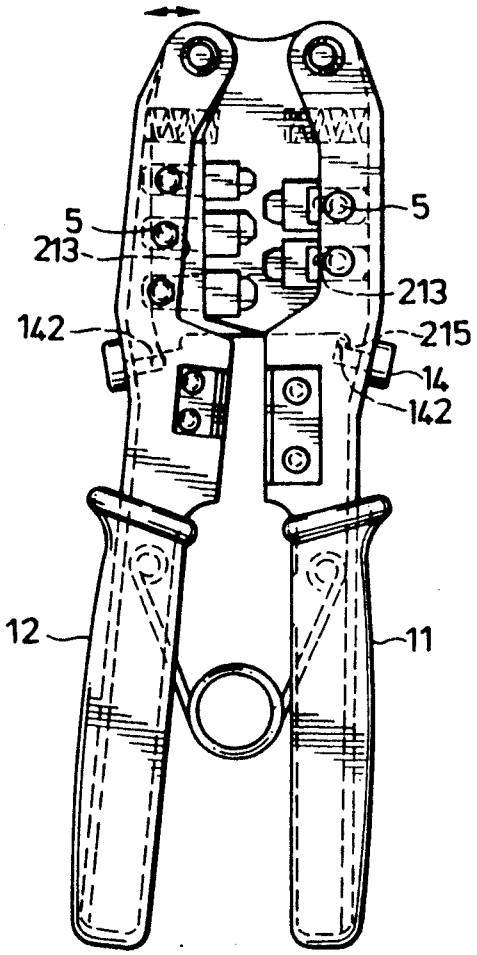
FIG. 9 shows the crimper of the present invention at a releasing position, wherein the press portions are spaced from the contact faces of the crimper.

Referring to FIGS. 5 and 6, a crimper (1) for crimping telephone cables into differently-sized connectors in accordance with the present invention is shown to include first and second handle members (10), each of which has a lower elongated hand grip portion (11, 12) sleeved into a rubber holder (114,124) to facilitate handling, an upper press portion (101,102) extending upward from the lower hand grip portion (11, 12) and a pivot portion (111,121) extending substantially upward from the press portions (101, 102). Each of the pivot portions (111, 121) has two jaw plates extending parallel therefrom.

The head (20) is a solid member disposed between the press portions (101,102) of the first and second handle members (10). The head can be made of engineering plastic, may be molded, and is formed with a plurality of differently-sized receiving spaces (214) respectively configured to accommodate, one of the above-described connectors therein, and two opposed contact faces (23), a plurality of sets of throughbore pairs (24) extending from one of the contact faces. The preferred embodiment is shown to have five sets of throughbore pairs and five receiving spaces.

The throughbore pairs (24) serve as an access to a respective one of the receiving spaces. The head (20) further includes two aligned blind bores (212) to receive a respective compression spring (6) therein, the purpose of which will be described later. The lowermost portion of the head (20) has an engaging member (215), the purpose of which will also be described later. The head (20) further includes two opposite sides (25) which interconnect the contact faces (23). Five pairs of oblong holes (213) are formed through the two opposite sides (25) and extend in the same direction and are communicated with a respective one of the throughbore pairs (24). Five pairs of elongated press members (221, 222) are respectively and movably disposed in the throughbore pairs (24).

The press portions (101,102) of the first and second handle members (10)each has two wings extending therefrom and which are spaced apart from one another by a distance substantially equal to the width of the contact face (23). Thus, when the pivot portions (111, 121) of the first and second handle members (10) are pivoted to the topmost portion of the head (20), the wings confine the contact face (23) therebetween, and the press portions (101, 102) are disposed adjacent to the contact faces (23). Under such condition, a plurality of locking pins (5) are inserted through holes on the wings, the oblong holes (213), and holes on the press members (221,222), thus connecting the first and second handle members (10) to the head (20). Once the handle members (10) are connected to the head (20), the press members (221, 222) can move in the throughbores (24) between a first position, wherein a first end of the press members (221, 222) protrudes out of the head (20) through the contact face (23) while a second end of the press members (221, 222) retracts into the respective throughbore (24), and a second position, wherein the first end of the press members retracts into the respective throughbore (24) while the second end of the press members (221, 222) extends into the corresponding receiving space (214). The compression springs (6) are provided in the blind bores (212) and bias the press portions (101, 102) constantly so that the press members (221, 222) are at the first position when the hand grip portions (11, 12) of the crimper (1) are not squeezed toward one another.

After the first and second handle members (10) are pivoted to the head (20), the first and second handle members (10) can pivot relative to the head (20) between a crimping position, wherein the grip portions (11, 12) of the first and second handle members (10) are squeezed toward one another such that the press portions (101, 102) abut with the contact faces (23) of the head (20) so as to press the press members (221, 222) toward the second position to permit the second end of the press members (221, 222) extend into the respective receiving spaces (214) to crimp the electric terminals thereat, and a releasing position, where the press portions (11, 12) of the first and second handle members (10) are spaced from the contact faces (23) of the head (20) to permit movement of the press members (221, 222) to protrude out of the contact faces (23).

A torsion spring (13) can be attached to the first and second hand grip portions (11,12) by means of two pins. The torsion spring (13) bias pushes the first and second hand grip portions (11, 12) away from one another.

The crimper (1) of the present invention can also be used for stripping and cutting electrical conductors. Each of the first and second handle members (10) has a cutting blade (113, 123) formed on the hand grip portions (11, 12) posterior to the press portions (101, 102) which cutting blades (113, 123) cooperate with one another to form a wire stripping component. When stripping a conductor, the conductor is put between the cutting blades (113,123). The cutting blades (113, 123) do not abut with one another when the handle members (10) are squeezed because of the presence of a stop projection (114) on the grip portion (11, 12).

Each of the hand grip portions (11,12) has an adjustable knob (141) which includes a shaft that extends into the head (20), a free end of which is provided with a hook portion (142). When the adjustable knob (141) is rotated in a predetermined direction, the hook portion (142) engages the engaging member (215) of the head (20). When a user wishes to use the receiving spaces (214) on one side of the head (20), the other handle member (10) on the opposite side can be locked by turning the respective adjustable knob (141).

Note that only a single mold is required to produce the head (20) with differently-sized receiving spaces (214), thus decreasing the cost of constructing many molds as required in a conventional crimper. In the preferred embodiment, the locking pins (5) that hold the press members (221, 222) are mounted in the oblong holes (213) which extend in the direction of the throughbores (24). Thus, pressure which is applied on the hand grip portion (11, 12) of the handle members (10) are directly concentrated on the press members (221, 222). The press members (221, 222) need not be adjusted its position relative to the receiving spaces (214) as required in the prior art model. In addition, the assembly process of the crimper (1) of the present invention is easier since the receiving spaces (214) in the head (20) are formed while the head (20) is molded. In the conventional crimper, a crimping block (C21, C22) which is fitted over the notches (C14, C15) so as to form the receiving spaces (f, g) must be separately made, thus making the assembly of the conventional crimper more difficult than the present crimper. In the present crimper (1), once the first and second handle members (10) are pivoted to the head (20), the locking pins (5) can be inserted through the wings of the press portions (101, 102) to connect with the press members (221, 222).

While a preferred embodiment has been illustrated and described, it will be apparent that many changes and modifications may be made in the general construction and arrangement of the present invention without departing from the spirit and scope thereof. Therefore, it is desired that the present invention be not limited to the exact disclosure but only to the extent of the appended claims.

I claim:

1. A crimper for crimping multi-wire telephone cable into one of at least two connectors of different dimensions, said telephone cable having a plurality of wires and a sheath with a stripped end to expose said wires, each of said connectors having a blind bore to receive one end of said telephone cable therein, a plurality of electric terminals extending into said blind bore and being respectively aligned with said wires and a pressing plate adjacent to said plurality of electric terminals, said crimper crimping said plurality of electric terminals of said connector to effect tight contact with said wires and further crimping said pressing plate so as to engage said sheath, said crimper comprising:

a first handle member having a lower first grip portion, an upper first press portion extending upward from said lower first grip portion and a first pivot portion extending upward from said upper first press portion;

a second handle member having a lower second grip portion, an upper second press portion extending upward from said lower second grip portion and a second pivot portion extending upward from said upper second press portion;

a solid head member having at least two receiving spaces respectively configured to accommodate one of said connectors therein, two opposed contact faces, at least two sets of throughbore pairs extending from one of said contact faces so as to access a respective one of said receiving spaces, at least two sets of pressing units, each set of pressing units including a pair of elongated press members disposed in a respective one of said sets of throughbore pairs, means for connecting said elongated press members to said head member to permit movement of said elongated press member between a first position, wherein a first end of said elongated press members protrudes out of said contact face while a second end of said press members retracts into the respective one said throughbores, and a second position, wherein said first end of said press members retracts into the respective one of said throughbores while said second end of said elongated press members extends into the respective one of said receiving space, and a biasing means to bias said elongated press members toward said first position;

said first and second pivot portions of said first and second handle members being pivoted to an uppermost portion of said head member, said two opposed contact faces being respectively disposed adjacent to said press portions, said first and second handle members being pivotable relative to said head member between a crimping position wherein said first and second press portions abut with said contact faces to urge said press members toward said second position so as to crimp said electric terminals and said pressing plate, and a releasing position, wherein said first and second press portions are spaced from said contact faces of said head member to allow movement of said press members toward said first position; and a spring means to bias said first and second handle members toward said releasing position.

2. A crimper as claimed in claim 1, wherein said head member further includes an engaging member formed at a lowermost portion thereof, each of said first and second handles having an adjustable knob that includes a central shaft which extends into the respective said press portion, said central shaft having a free end with a hook portion, rotation of said adjustable knob in a predetermined direction relative to the respective said press portion causing said hook portion to engage said engaging member so as to position the respective said handle member at said crimping position.

3. A crimper as claimed in claim 1, wherein said head member further includes two opposite sides interconnecting said opposed contact faces, each of said press members having a throughhole extending therethrough, said connecting means including at least two pairs of oblong holes formed through said opposite sides and extending in a direction similar to that of said throughbore pairs and being in communication with a respective one of said sets of said throughbore pairs, said connecting means further including at least two locking pins inserted into said oblong holes and passing through said throughholes of said elongated press members to connect movably said elongated press member and said head member.

* * * * *